US007188665B2

(12) United States Patent
Arai et al.

(10) Patent No.: US 7,188,665 B2
(45) Date of Patent: Mar. 13, 2007

(54) HEAT EXCHANGER AND HEAT EXCHANGER VENTILATOR

(75) Inventors: Hidemoto Arai, Tokyo (JP); Kenzou Takahashi, Tokyo (JP); Youichi Sugiyama, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 121 days.

(21) Appl. No.: 10/189,556

(22) Filed: Jul. 8, 2002

(65) Prior Publication Data

US 2003/0094269 A1 May 22, 2003

(30) Foreign Application Priority Data

Nov. 16, 2001 (JP) ..... 2001-351213

(51) Int. Cl.
*F28F 3/02* (2006.01)

(52) U.S. Cl. ..... 165/166; 165/133

(58) Field of Classification Search ..... 165/166
See application file for complete search history.

(56) References Cited

U.S. PATENT DOCUMENTS

| | | | | |
|---|---|---|---|---|
| 4,377,400 | A * | 3/1983 | Okamoto et al. | 96/13 |
| 4,449,992 | A * | 5/1984 | Yamada et al. | 96/7 |
| 4,484,938 | A * | 11/1984 | Okamoto et al. | 96/118 |
| 5,832,993 | A * | 11/1998 | Ohata et al. | 165/166 |
| 6,019,170 | A * | 2/2000 | Yokoya et al. | 165/166 |
| 6,536,514 | B1 * | 3/2003 | Sugiyama et al. | 165/166 |

FOREIGN PATENT DOCUMENTS

| | | | |
|---|---|---|---|
| JP | 47-19990 | | 9/1972 |
| JP | 51-2131 | | 1/1976 |
| JP | 53-34663 | | 3/1978 |
| JP | 56030595 | A * | 3/1981 |
| JP | 57-207795 | | 12/1982 |
| JP | 58-046325 | | 3/1983 |
| JP | 59107198 | A * | 6/1984 |
| JP | 60164197 | A * | 8/1985 |
| JP | 5-109005 | | 4/1993 |
| JP | 5-337761 | | 12/1993 |
| JP | 10-160379 | | 6/1998 |
| JP | 10183492 | A * | 7/1998 |
| JP | 2000087041 | A * | 3/2000 |
| JP | 2001-027489 | | 1/2001 |
| WO | WO 02/099193 | | 12/2002 |

* cited by examiner

*Primary Examiner*—Allen J. Flanigan
(74) *Attorney, Agent, or Firm*—Buchanan Ingersoll PC

(57) ABSTRACT

A heat exchanger for realizing a high degree of humidity exchange efficiency at a low cost. The heat exchanger in which partition members respectively separated from each other by a spacing maintained by one of spacing members facilitate circulation of two different air flows, with total enthalpy heat exchange occurring between these two air flows via the partition members. The partition members comprise an air shielding sheet type material comprising a hydrophilic fiber and also including a moisture absorbent, and the air permeability (JIS P 8117) of the partition members is at least 200 seconds/100 cc.

2 Claims, 3 Drawing Sheets

HEAT EXCHANGER AND HEAT EXCHANGER VENTILATOR

BACKGROUND OF THE INVENTION

1. Field of the Invention

The present invention relates to a heat exchanger and a heat exchange ventilator with a laminated structure for performing heat exchange between fluids and used mainly in the field of air conditioning.

2. Description of the Related Art

In recent years, air conditioning devices such as heaters and coolers have developed considerably and have also become more widely used, and as the living spaces using air conditioners have expanded, there has been an associated increase in awareness of the importance of heat exchangers for air conditioning devices capable of recovering heat and humidity during the ventilation process. Conventional air conditioning heat exchangers such as those disclosed in Japanese Patent Publication No. Sho 47-19990 and Japanese Patent Publication No. Sho 51-2131 are in widespread use.

All of these conventional heat exchangers employ a basic structure in which partition plates which transfer heat and are moisture permeable are separated using spacer plates, and a plurality of the layers are then superposed with a predetermined spacing between the layers. The partition plates are square flat plates, whereas the spacer plates are corrugated plates formed in either a sawtooth wave shape or a sine wave shape which in a projection plane thereof matches the partition plates.

Furthermore, each of the spacer plates is held between the adjacent partition plates so that the formation directions of the corrugations of the spacer plates alternately cross at an angle of either 90 degrees or an angle close to 90 degrees. The fluid passages of the dual system are formed so that the first air flow and the second air flow are separated, and the fluid passages running through the respective layers each comprising the spacer plate and the partition plate are formed with alternating orthogonality.

The properties required for the partition plates of a heat exchanger are a low degree of air permeability and a high level of moisture permeability. This is because in order to ensure that, during operation of the heat exchanger, heat exchange of both sensible heat and latent heat can be performed concurrently, with no mixing between the external fresh air drawn into the room from outside, and the foul air being discharged outside from inside the room, it is necessary that water vapor be able to migrate efficiently between the intake air and the exhaust air.

Examples of partition plate materials capable of coping with these demands include the gas shielding materials disclosed in Japanese Patent Publication No. Sho 58-46325. These materials are obtained by impregnating or coating a porous member with a water soluble polymer material including a halogenated lithium as a moisture absorbent. Furthermore, Japanese Patent Publication No. Sho 53-34663 discloses a method of improving the flame retardation by mixing, where necessary, a guanidine based flame retardant with the water soluble polymer material before the impregnation or coating process.

In a heat exchanger comprising partition plates constructed of the above type of moisture permeable gas shielding material formed by impregnating or coating a porous member with a water soluble polymer material, a problem arises in that under conditions of high temperature and high humidity, such as those encountered in summer, moisture absorption by the partition plates may cause a portion of the water soluble polymer material to dissolve, resulting in a blocking phenomenon and causing the material to break or tear during rewinding operations such as corrugating. Furthermore, this type of heat exchanger is produced by laminating a plurality of heat exchanger structural members together, with each structural member comprising a single faced corrugated structure obtained by corrugating and bonding the material of the spacer plate to the material of the partition plate.

The corrugation process is centered around upper and lower gear shaped corrugators which rotate and intermesh with each other and which are used for forming the spacer plate, and a press roller for pressing the partition plate material onto the spacer plate material while rotating. In order to ensure the corrugated shape of the spacer plate, the upper and lower corrugators and the press roller are normally maintained at a high temperature of at least 150° C. Consequently, a portion of the water soluble polymer material of the partition plate material tends to melt with the heat from the press roller and fuse to the press roller. Although this fusion of the partition plate material to the press roller can be prevented by lowering the temperature of the press roller, lowering the temperature can cause a collapse of the corrugated shape, making the product unusable as a heat exchanger structural member.

In order to overcome this problem, conventionally, the temperature of the press roller and the upper and lower corrugators is adjusted to a temperature at which fusion is unlikely to occur, and the feed speed is lowered to prevent any collapse of the corrugations. As a result, the productivity drops significantly, and the production costs increase. Furthermore, heat exchangers produced using a partition plate formation method which requires no chemical processing, such as those disclosed in Japanese Patent Application No. Hei 5-109005 and Japanese Patent Application No. Hei 5-337761, are also in widespread use.

In a device of the type in which two different air flows are separated by partition plates, and heat exchange of sensible heat and latent heat of these two air flows occurs through the partition plates, the partition plates are formed from a porous sheet onto one side of which is formed a composite moisture permeable film comprising a thin film of a water insoluble hydrophilic polymer which is permeable to water vapor. Consequently, there is no deformation of the device even when used in an environment which suffers repeated dew condensation, and a total enthalpy heat exchanger can be provided which suffers no deterioration in performance, even with extended use. Moreover, because the hydrophilic polymer thin film is insoluble in water, it does not mobilize and flow, and so deterioration in performance with time does not occur.

In those cases where a resin film such as that described above is used for the partition plates, a base material to which the resin is applied is necessary, and so the total thickness of the partition plate increases, and as a result, the moisture permeability of the plate decreases.

Furthermore, mixing a moisture absorbent with the resin during film formation in order to improve the moisture permeability results in unsatisfactory film formation, and attempts to impregnate or coat a completed film with a moisture absorbent do not allow the addition of the required amount of moisture absorbent.

Furthermore, another problem associated with a highly moisture permeable resin film is that it is too expensive when compared with one employing a porous base such as paper.

SUMMARY OF THE INVENTION

Accordingly, the present invention has been designed to overcome the conventional problems described above, and it is an object to provide a heat exchanger and a heat exchange ventilator which are capable of realizing a high degree of humidity exchange efficiency at a low cost.

The present invention provides a heat exchanger in which partition members respectively separated from each other by a spacing maintained by one of spacing members facilitate circulation of two different air flows, with total enthalpy heat exchange occurring between the two air flows via the partition members, wherein the partition members comprise an air shielding sheet type material comprising a hydrophilic fiber and also including a moisture absorbent.

Furthermore in the aforementioned heat exchanger, the air permeability (JIS P 8117) of the partition members is at least 200 seconds/100 cc.

Furthermore in the aforementioned heat exchanger, the primary constituent of the aforementioned hydrophilic fiber is cellulose fiber.

Furthermore in the aforementioned heat exchanger, the primary constituent of the aforementioned moisture absorbent is an alkali metal salt.

Furthermore in the aforementioned heat exchanger, the film thickness of the partition members is within a range from 10 microns to 50 microns.

Furthermore in the aforementioned heat exchanger, the partition members include a flame retardant which does not react with the alkali metal salt or the primary constituent of the moisture absorbent.

Furthermore in the aforementioned heat exchanger, the aforementioned spacing member includes a flame retardant which does not contribute to the moisture permeability.

The present invention also provides a heat exchange ventilator with a heat exchanger in which partition members respectively separated from each other by a spacing maintained by one of spacing members facilitate circulation of two different air flows, with total enthalpy heat exchange occurring between the two air flows via the partition members, wherein the partition members comprise an air shielding sheet type material comprising a hydrophilic fiber and including a moisture absorbent.

Furthermore in the aforementioned heat exchange ventilator, the air permeability (JIS P 8117) of the partition members is at least 200 seconds/100 cc.

DETAILED DESCRIPTION OF THE PREFERRED EMBODIMENTS

As follows is a description of embodiments of the present invention made with reference to the drawings.

Embodiment 1.

Figure 1:
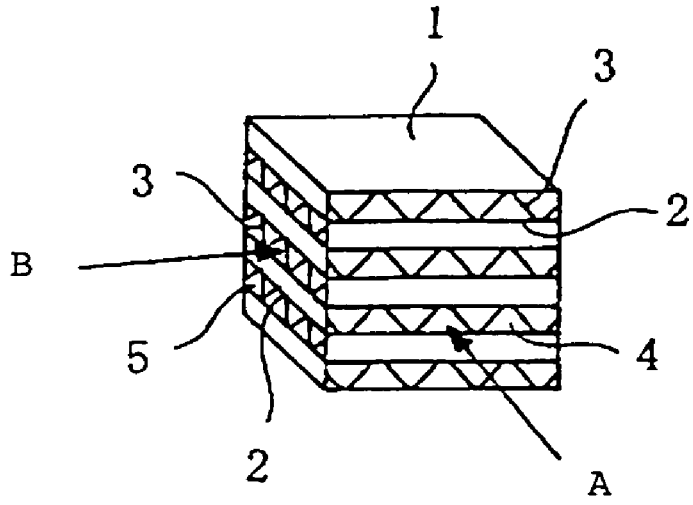
FIG. 1 is a perspective view showing a heat exchanger of an Embodiment 1 according to the present invention.
Figure 2:
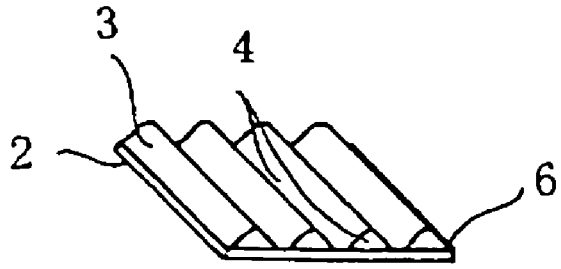
FIG. 2 is a perspective view showing the heat exchanger structural member of the heat exchanger shown in FIG. 1.
Figure 3:
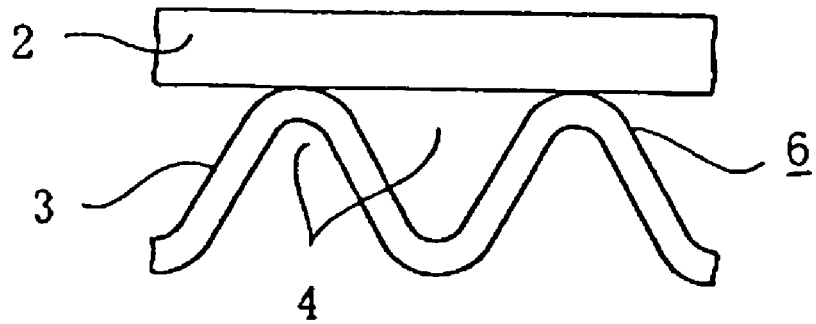
FIG. 3 is an enlarged end view of the heat exchanger structural member shown in FIG. 2.
Figure 4:
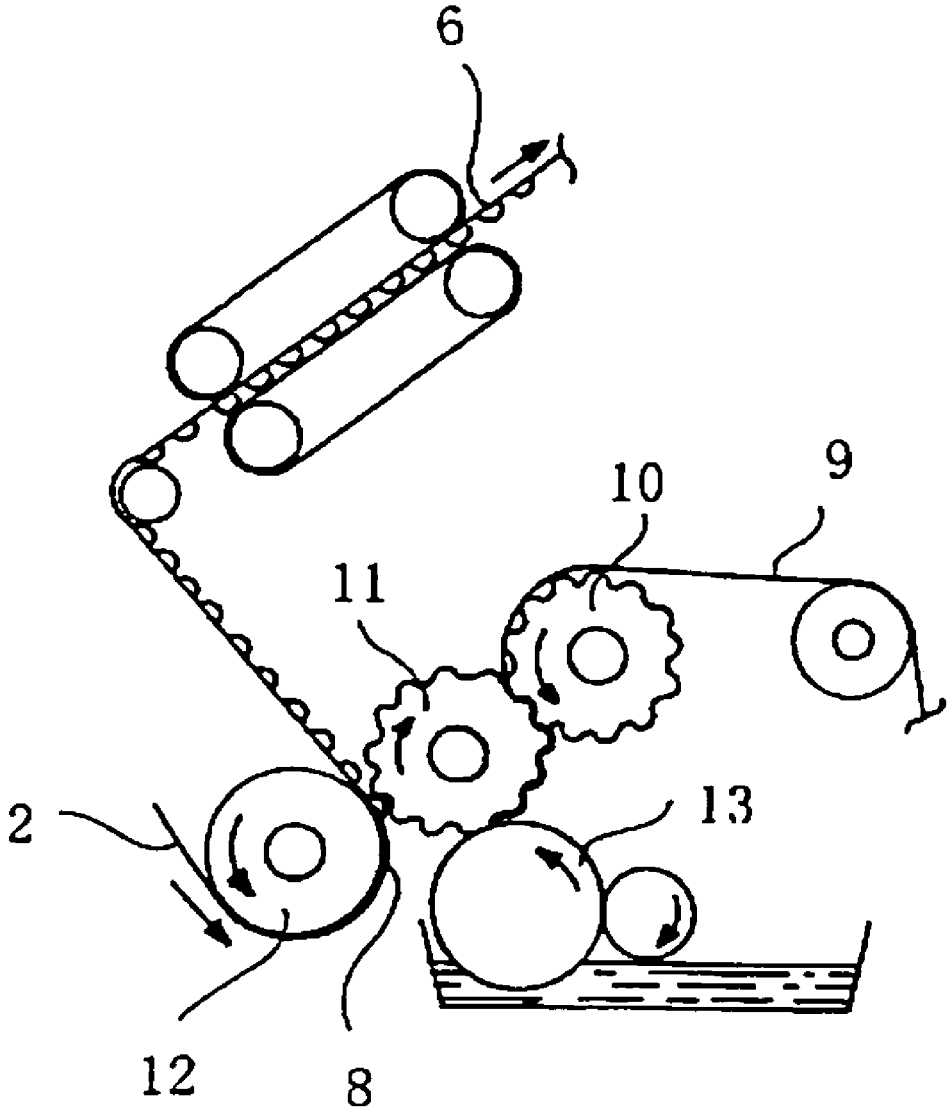
FIG. 4 is a structural diagram showing a single facer machine for performing corrugation processing of the heat exchanger shown in FIG. 1.

FIG. 1 is a perspective view showing a heat exchanger of an Embodiment 1 according to the present invention, FIG. 2 is a perspective view showing the heat exchanger structural member of the heat exchanger shown in FIG. 1, FIG. 3 is an enlarged end view of the heat exchanger structural member shown in FIG. 2, and FIG. 4 is a structural diagram showing a single facer machine for performing corrugation processing of the heat exchanger shown in FIG. 1. This embodiment is described using as an example, a laminated hexahedron type heat exchanger 1 suitable for air conditioning purposes, such as that shown in FIG. 1.

The heat exchanger 1 is composed of a structure wherein thin partition members 2 which transfer heat and are moisture permeable are separated using spacing members 3, and a plurality of the layers are then superposed and bonded together with a predetermined spacing between the layers. The partition members 2 of the heat exchanger 1 are square or rhombus shaped flat plates, and the spacing members 3 are corrugated plates formed in either a sawtooth wave shape or a sine wave shape with a shape in a projection plane thereof which matches the partition members 2.

Each of the spacing members 3 is held between the adjacent partition members 2 so that the directions at the formation directions of the corrugations alternate at an angle of either 90 degrees or an angle close to 90 degrees. Fluid passages 4 and fluid passages 5 are respectively formed within the layers each comprising the spacing member 3 and the partition member 2, and are formed with alternating orthogonality. A first air flow (a) flows through the fluid passages 4, and a second air flow (b) flows through the fluid passages 5.

As shown in FIG. 2 and FIG. 3, the heat exchanger 1 is produced by laminating and bonding a plurality of heat exchanger structural elements 6 each formed by bonding a spacing member 3 to one side of a single partition member 2. As shown in FIG. 3, the heat exchanger structural element 6 is produced in a continuous manner by using a flat air shielding sheet as the partition member 2, and then bonding the spacing member 3 which forms the fluid passages 4 or 5 to the partition member 2 using the corrugation processing described below.

The sheet thickness of the partition member 2 should be kept as thin as possible from the viewpoint of moisture permeability performance, although if the sheet is too thin then tensile strength is lower during subsequent processing, and the sheet may tear during the processing. Taking both the moisture permeability and tensile strength into consideration, the thickness of the partition member 2 may preferably be from 10 to 50 μm. If the production technology stability of the paper material which constitutes the partition member 2 is also taken into consideration, then the lower limit becomes approximately 25 μm.

In this embodiment, a paper partition member 2 with a thickness within a range from 10 to 50 μm and a basis weight of 10 to 50 ($g/m^2$) is used. Cellulose fiber is preferably used as the primary constituent of the hydrophilic fiber of the paper which forms the partition member 2. In this manner, by using cellulose fiber as the primary constituent of the hydrophilic fiber of the paper which forms the partition member 2, the tensile strength can be increased at low cost.

This partition member 2 is prepared by wet beating using an alkali solution or the like to obtain a fine hydrophilic fiber, making a paper in a warm water using the highly beaten hydrophilic fiber, rolling a wet paper with a moisture content of 15 to 25%, and subsequently calendaring the paper by compressing the paper with rollers. The conditions for the respective process steps are adjusted and combined. These processes enable a partition member 2 comprising an air shielding sheet type material to be prepared. Furthermore, because the partition member 2 is subjected to a high pressure at the same time as the drying process, a partition member 2 can be prepared which displays high density, good moisture permeability and a high degree of smoothness.

If the moisture content of the paper during paper making is too high, then blocking and tearing of the paper is more likely to occur during rolling, whereas if the calendaring is performed on paper with a moisture content which is too low, then the desired high density paper is difficult to obtain. It is assumed that the reason for this observation is that if the paper is too dry, movement between fibers decreases and so the shift to higher densities caused by recombination of fibers is less likely to proceed. Taking these factors into consideration, rolling should preferably be performed on wet paper with a moisture content during paper making within the range from 15 to 25%.

The partition member 2 is prepared so that the porosity is suppressed to approximately 20% to ensure an air permeability of at least 5000 sec/100 cc. By ensuring that the air permeability is at least 5000 sec/100 cc, the migration rate of carbon dioxide gas, which is an important factor for a heat exchange ventilator, can be suppressed to a value of no more than 1%. Considering the desirability of suppressing this migration rate of carbon dioxide gas, which is an important factor for a heat exchange ventilator, to a value of no more than 1%, it is preferable that an air permeability value of at least 5000 sec/100 cc is maintained. In cases in which the migration rate of carbon dioxide gas is to be suppressed to no more than 5%, an air permeability of at least 200 sec/100 cc is sufficient.

Because the partition member 2 is produced with a high degree of wet beating, the cellulose fibers are short and a fuzzy state can be produced. As a result, the fibers become very interwoven enabling the tensile strength to be increased, and moreover enabling a high density product to be produced on compression. The reason why a fine hydrophilic fiber was used for the partition member 2 is described below. Hydrophilic fibers such as cellulose fibers form very high density products which are impermeable to air.

As a result, it becomes very difficult for water vapor to pass through the cavities between fibers from the high concentration side to the low concentration side. It is thought that any such migration occurs through attraction by hydroxyl groups on the fiber surface, migration through the fiber to the low concentration side according to the laws of diffusion, and subsequent vaporization. Due to this principle, if the material does not include a large quantity of hydroxyl groups, then the moisture permeability will be lost, in a similar manner to resin films such as polyethylene. Accordingly, the partition member 2 must utilize hydrophilic fibers of a material which includes a large quantity of hydroxyl groups.

In order to improve the air shielding properties, it is preferable that the partition member 2 is compressed to a high density. Furthermore, in preparation for the chemical impregnation conducted in subsequent steps, artificial bonds are introduced between fibers during the paper making process by using a thermosetting resin such as melamine resin, urea resin or an epoxidized polyamide resin as a wet paper strength enhancing agent. The thus obtained partition member 2, constructed of an air shielding sheet type material, is subsequently subjected to immersion or coating treatment with an alkali metal salt such as lithium chloride which functions as a moisture absorbent, and with guanidine sulfamate which is one of the guanidine salts typically used as paper flame retardants and which does not form a salt on reaction with lithium chloride, with each immersion or coating treatment using 20% by weight of the compound relative to the weight of the sheet.

A partition member 2 constructed in this manner from an air shielding sheet type material includes a moisture absorbent, and so it becomes easier for the material to draw moisture in, enabling the migration of water vapor to happen more smoothly, and as a result the moisture permeability can be improved. Furthermore, because the primary constituent of the moisture absorbent is an alkali metal salt, it can be readily dissolved in water. Consequently, the preparation of the chemicals can be performed smoothly, the operation can be completed easily, and the washing of the equipment is also simplified. Furthermore, because alkali metal salts offer extremely good moisture absorption, the moisture permeability can be improved with even small amounts of added salt.

By using a flame retardant (such as guanidine hydrochloride or a sulfamate based guanidine) which does not react with the alkali metal salt or the primary constituent of the moisture absorbent, and then incorporating this flame retardant within the partition member 2, flame resistant properties can be conferred on the heat exchanger 1. Moreover, chemical processing of the partition member 2 can be completed in a single process, enabling an improvement in operating efficiency. Examples of typically used paper flame retardants are the guanidine salts.

Of the guanidine salts, guanidine phosphate and guanidine sulfamate are in actual use. However, if guanidine phosphate is used as a moisture absorbent in paper, then the thermal stability of the flame retardant paper obtained can be unsatisfactory, leading to a tendency for a marked color change during heat treatment. As a result, the actual usable salts are limited, and guanidine sulfamate is used in preference.

Furthermore, in those cases in which lithium chloride is used as a moisture absorbent, because phosphorus is known to react with lithium to generate a salt, phosphorus cannot be used. For the above reasons, of the guanidine salts, either guanidine sulfamate or guanidine hydrochloride is preferably used. The latter, guanidine hydrochloride, has moisture absorbing properties, and so is unsuitable as a paper flame retardant. However, in a total enthalpy heat exchanger, because the moisture absorption is good, guanidine hydrochloride has been used conventionally. In recent years, however, materials including chlorine have been avoided due to associated dioxin problems, and so there is a trend towards the use of guanidine sulfamate.

In preparing the air shielding sheet for the partition member 2, by carrying out flame retardant and moisture absorbent treatments on a non-porous sheet which has been compressed to a high density, a sheet with air shielding, moisture absorbent, and flame retardant functions can be produced. In addition to this partition member 2, a material 9 (paper material) of the spacing member 3 comprising cellulose fibers as the primary constituent is then fed through the single facer machine shown in FIG. 4 and corrugated, producing in a continuous manner the single faced corrugated type heat exchanger structural element 6.

The single facer machine for performing the corrugation processing is constructed around upper and lower gear shaped corrugators 10, 11 which rotate in mesh with each other and which are used for forming the spacing member 3, a press roller 12 for pressing the material of the partition member 2 onto the material 9 of the spacing member 3 while rotating, and a sizing roller 13. The upper and lower corrugators 10, 11 and the press roller 12 are maintained at a high temperature to enable the step-shaped corrugations of the spacing member 3 to be more easily formed.

The sizing roller 13 applies an aqueous solvent-type vinyl acetate based emulsion adhesive to the peaks of the corrugations of the material 9 of the corrugated spacing member 3 being fed out of the lower corrugator 11. The material of the partition member 2 is fed around the press roller 12 with a moisture permeable film 8 facing outwards, and the side of the partition member 2 comprising the moisture permeable film 8 becomes the adhesion surface with the material 9 of the spacing member 3. By cutting the heat exchanger structural element 6 produced in this manner, and then laminating and bonding layers of the element together with a 90 degree rotation in direction between the alternating layers, a heat exchanger 1 such as that shown in FIG. 1 can be produced. Moreover, by arranging and laminating the heat exchanger structural elements 6 so that the corrugation wave directions of the spacing members 3 are parallel, a counter flow heat exchanger can be obtained.

The feature of this method of producing a heat exchanger 1 is that a water soluble and heat fused air shielding polymer film is not provided. As a result, within the single facer machine shown in FIG. 4 used for conducting the corrugation processing, even if the temperature of the upper and lower corrugators 10, 11 for forming the corrugations and the press roller 12 is maintained at a high temperature, the air shielding sheet used as the material for the partition member 2 does not fuse onto the press roller 12, and the corrugation processing can be conducted at a high temperature which makes for easier formation of the corrugations, and with a fast feed speed.

Furthermore, because a water soluble polymer film which functions as an air shielding layer is not provided on the surface of the partition member 2 as in conventional materials, the adhesion during processing improves, and so the processing can be conducted with a much faster feed speed than that used in the conventional corrugation processing. As a result, the productivity can be improved significantly. In addition, in comparison with conventional porous paper materials, because products of the present embodiment are subjected to high levels of beating, although the tear strength deteriorates, an increase in bonding strength enables an increase in the bursting strength, the tensile strength and the folding endurance. Furthermore, even with a very thin film the tensile strength is sufficient to endure subsequent processing, and the conventional film thickness of approximately 100 microns can be reduced to approximately 20 microns, enabling the moisture permeation resistance to be reduced to ⅕ of conventional values.

Figure 5:
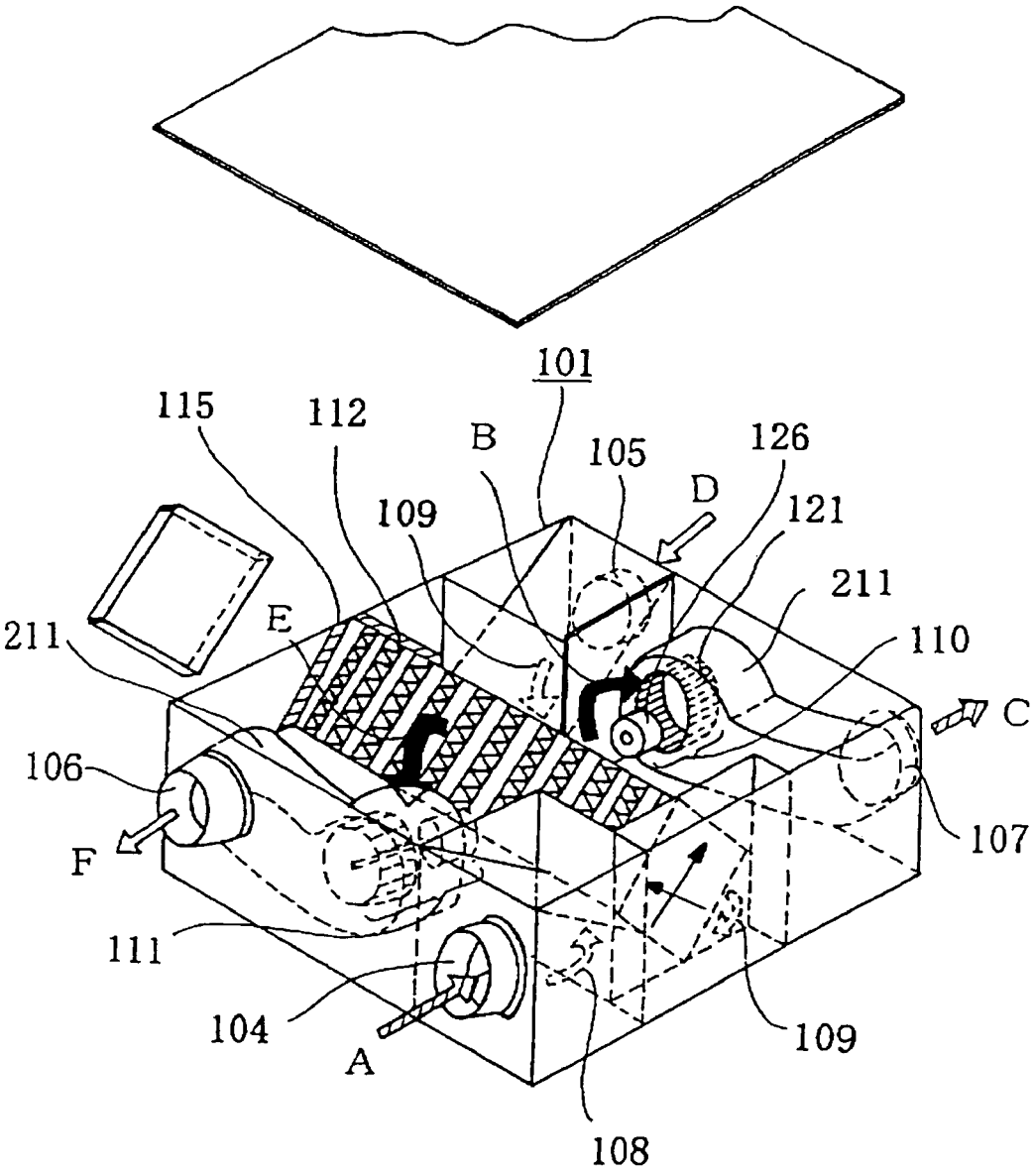
FIG. 5 is a perspective view showing a heat exchange ventilator using the heat exchanger shown in FIG. 1.

FIG. 5 is a perspective view showing a heat exchange ventilator using the heat exchanger shown in FIG. 1. This heat exchange ventilator comprises a housing 101 with an internal inlet port 104 and outlet port 106 on one of two opposing sides and an external inlet port 105 and outlet port 107 on the other side, inside of which is provided a heat exchanger 112 positioned between the aforementioned inlet ports 104, 105 and outlet ports 107, 106, and equipped with a supply passage 109 and an exhaust passage 108 which are positioned so as to cross one another and enable heat exchange.

Then, within the supply passage 109 and the exhaust passage 108, which are attached to the housing 101 in a removable manner, are provided blade casings 211 provided within the supply passage 109 and the exhaust passage 108 which house blowers 110, 111 respectively each comprising a blade 121 and an electric motor 126 for generating the supply flow and the exhaust flow respectively, and the heat exchanger 112 for conducting heat exchange between the aforementioned supply flow and exhaust flow which is provided so as to be removable from an aperture 115 positioned in another side surface of the housing.

Next is a description of the operation of this heat exchange ventilator. In the heat exchange ventilator constructed in the manner described above, during air conditioning ventilation using the heat exchanger 112, by operating the respective blowers 110, 111, the internal air is drawn in via the ducting through the internal inlet port 104 in the direction of the arrow A, passes through the heat exchanger 112 and the exhaust passage 108 in the direction of the arrow B, and is then blown out through the external outlet port 107 by the exhaust blower 110 as shown by the arrow C.

Furthermore, the external air is drawn in via the ducting through the external inlet port 105 in the direction of the arrow D, passes through the heat exchanger 112 and the supply passage 109 in the direction of the arrow E, is blown out through the internal outlet port 106 by the supply blower 111 as shown by the arrow F, and is then supplied internally via the ducting. During this time, heat exchange occurs in the heat exchanger 112 between the exhaust flow and the supply flow, and the heat is recovered from the exhaust flow and used for reducing the load on the heater or cooler. Provided a heat exchanger according to the embodiment described above is used, the humidity exchange efficiency of the heat exchange ventilator can be improved by approximately 10%.

Embodiment 2.

In a similar manner to the Embodiment 1, this embodiment also relates to a laminated hexahedron type heat exchanger suitable for air conditioning purposes. With the exception of the composition of the partition members, this embodiment is basically the same as the Embodiment 1. Accordingly, FIG. 1 through FIG. 3 also apply to this embodiment so that those components which are identical with those of the Embodiment 1 are designated with the same reference numerals as those used for the Embodiment 1, and description of those components is omitted.

In a similar manner to the Embodiment 1, the heat exchanger 1 of this embodiment comprises the structure shown in FIG. 1, wherein the thin partition members 2 which transfer heat and are moisture permeable are separated using the spacing members 3, and a plurality of the layers are then superposed and bonded together with a predetermined spacing between the layers. The partition members 2 of the heat exchanger 1 are square or rhombus shaped flat plates, and the spacing members 3 are corrugated plates formed in either a sawtooth wave shape or a sine wave shape with a shape in a projection plane thereof which matches the partition members 2.

Each of the spacing members 3 is held between the adjacent partition members 2 so that the formation directions of the corrugations alternate at an angle of either 90 degrees or an angle close to 90 degrees. The fluid passages 4 and the fluid passages 5 are formed within the layers each composed of the spacing member 3 and the partition member 2, and are formed with alternating orthogonality. The first air flow (a) flows through the fluid passages 4, and the second air flow (b) flows through the fluid passages 5.

As was the case for the Embodiment 1, and as shown in FIG. 2 and FIG. 3, this heat exchanger 1 is also produced by laminating a plurality of the heat exchanger structural elements 6 each formed by bonding the spacing member 3 to one side of the single partition member 2. The heat exchanger structural element 6 is produced in a continuous manner by using the similar air shielding sheet to the Embodiment 1 as the partition member 2, performing impregnation or coating treatment of this sheet with lithium chloride as a moisture absorbent, and then bonding the material 9 of the spacing member 3 which forms the fluid passages 4, 5 to the thus formed air shielding material of the partition member 2 using the corrugation processing.

The air shielding sheet which forms the partition member 2 can be selected from the same sheets as for the Embodiment 1. In order to further improve the moisture permeability, the impregnation or coating is conducted using only lithium chloride as the moisture absorbent dissolved in an aqueous solvent. Due to the low porosity level, the air shielding sheet is poorly permeated by chemicals, and as a result, there is a danger that large amounts of chemicals cannot be applied. In other words, even if attempts are made to apply large quantities of the lithium chloride moisture absorbent in order to improve the moisture permeability, if the moisture absorbent is applied at the same time as the flame retardant, then the quantity of the moisture absorbent which can be applied is insufficient.

Accordingly, by coating the air shielding sheet with only lithium chloride as the moisture absorbent, then in comparison with the coating build-up of lithium chloride of approximately 2 $g/m^2$ for the Embodiment 1, an approximately two fold increase to a coating build-up of lithium chloride of approximately 4 $g/m^2$ can be achieved, and so the moisture permeability can be improved even further. With regards to flame retardation, provided a JIS A1322 compliant material known as a flame resistant paper is used for the spacing member 3, then as an overall unit, a flame retardant heat exchanger structural element 6 can still be constructed.

This flame resistant paper is a paper with a thickness of 60 to 120 μm, and a basis weight of 25 to 150 ($g/m^2$) produced by either an internal method in which fine powder of a water insoluble flame retardant is incorporated within the paper, or a post process method in which a water dispersion of a flame retardant is impregnated, sprayed or coated onto a produced paper. The air shielding sheet which forms the partition member 2 then becomes a material with both an air shielding function and a moisture absorption function produced by performing a moisture absorption treatment on a non-porous sheet which has been compressed to a high density. In addition to this partition member 2, the material 9 of the spacing member 3 comprising cellulose fibers as the primary constituent and also having flame retardation properties is then fed through a single facer machine and corrugated, producing in a continuous manner the single faced corrugated type heat exchanger structural element 6. By cutting the heat exchanger structural element 6 produced in this manner, and then laminating and bonding layers of the element together with a 90 degree rotation in direction between the alternate layers, a heat exchanger 1 such as that shown in FIG. 1 can be produced.

According to this method, because a flame resistant paper which has already undergone a flame resistant treatment is used as the material for the partition member 2, the amount of chemical coating required to form the moisture permeable film 8 can be reduced from the amount used in the method relating to the Embodiment 1, and so the productivity can be improved even further by increasing the speed of the chemical coating within the production process. Other effects are similar to those observed for the Embodiment 1.

In addition, by increasing the level of beating in comparison with conventionally used porous paper materials, although the tear strength deteriorates, an increase in bonding strength enables an increase in the bursting strength, the tensile strength and the folding strength. Furthermore, even with a very thin film the tensile strength is sufficient to endure subsequent processing, and the conventional film thickness of approximately 100 microns can be reduced to approximately 20 microns, enabling the moisture permeation resistance to be reduced to ⅕ of conventional values.

Furthermore, a heat exchanger of this embodiment can also be applied to a heat exchange ventilator of the Embodiment 1 shown in FIG. 5. Then, provided a heat exchanger according to the embodiment described above is used, the humidity exchange efficiency of the heat exchange ventilator can be improved by approximately 10%. Moreover with this embodiment, as was the case for the Embodiment 1, by laminating the cut heat exchanger structural elements 6 so that the corrugation directions of the spacing members 3 are parallel, a counter flow heat exchanger can be obtained.

Embodiment 3.

In the heat exchanger described in the Embodiment 2 above, there is a limit to the amount of lithium chloride moisture absorbent that can be applied, even if the lithium chloride is dissolved in an aqueous solvent prior to coating. Accordingly, if the moisture absorbent and polyvinyl alcohol (PVA) are dissolved in an aqueous solvent, with the polyvinyl alcohol acting as a binder, then the amount of lithium chloride which can be applied can be increased significantly. By coating only one side of an air shielding sheet of a partition member 2 with this chemical reagent and carrying out the corrugation processing on this chemically coated surface, then a favorable process can be achieved in which the PVA resin does not become sticky during the corrugation processing.

According to this method, lithium chloride can be applied in amounts of up to approximately 6 $g/m^2$. Following the completion of this coating process, and subsequent processing to form a heat exchanger, the coated chemical solution absorbs humidity and partially liquefies. As a result, the lithium chloride gradually penetrates into the air shielding sheet, and the difference in moisture permeability between the front and rear surfaces of the sheet disappears, enabling a further improvement in moisture permeability.

Furthermore, a heat exchanger of this embodiment can also be applied to a heat exchange ventilator of the Embodiment 1 shown in FIG. 5. Then, provided a heat exchanger according to the embodiment described above is used, the humidity exchange efficiency of the heat exchange ventilator can be improved by approximately 20% relative to conventional devices. Moreover, with this embodiment, as was the case for the Embodiment 1, by laminating the cut heat exchanger structural elements 6 so that the corrugation directions of the spacing members 3 are parallel, a counter flow heat exchanger can be obtained.

According to the present invention, by constructing a heat exchanger using partition members comprising an air shielding sheet type material of a hydrophilic fiber which also includes a moisture absorbent, a heat exchanger with a high degree of humidity exchange efficiency and a low gas migration rate can be produced.

Furthermore, in the heat exchanger described above, by constructing the aforementioned partition members so as to produce an air permeability of at least 200 sec/100 cc, gas migration through the partition members can be reduced, and so as a ventilator, the rate of gas leakage of the supply flow into the exhaust flow can be restricted to no more than 5%, enabling effective ventilation to be carried out.

Furthermore, in the heat exchanger described above, by using cellulose fiber as the primary constituent of the aforementioned hydrophilic fiber, the device can be produced at low cost, and the tensile strength can be increased.

In addition, in the heat exchanger described above, by using an alkali metal salt as the primary constituent of the aforementioned moisture absorbent, a high degree of humidity exchange efficiency can be achieved, and the moisture absorbent can also be readily dissolved in water, enabling an improvement in operating efficiency.

In addition, in the heat exchanger described above, by maintaining the film thickness of the aforementioned partition members within a range from 10 microns to 50 microns, the moisture permeability can be improved, and the likelihood of breaks during processing can be reduced.

Furthermore, in the heat exchanger described above, by constructing the aforementioned partition members so as to include a flame retardant which does not react with the alkali metal salt or the primary constituent of the aforementioned moisture absorbent, chemical processing of the partition members can be completed in a single process, enabling an improvement in operating efficiency.

Furthermore, in the heat exchanger described above, by constructing the aforementioned spacing members so as to incorporate a flame retardant which does not contribute to moisture permeability, a large amount of the moisture absorbent can be adhered, and so a high degree of humidity exchange efficiency can be achieved, and the operating efficiency can be improved.

According to the present invention, by constructing a heat exchange ventilator using partition members comprising an air shielding sheet type material of a hydrophilic fiber which also incorporates a moisture absorbent, a heat exchanger with a high degree of humidity exchange efficiency and a low gas migration rate can be produced.

Furthermore, in the heat exchange ventilator described above, by constructing the aforementioned partition members so as to produce an air permeability of at least 200 sec/100 cc, gas migration through the partition members of the heat exchanger can be reduced, and so as a ventilator, the rate of gas leakage of the supply flow into the exhaust flow can be restricted to no more than 5%, enabling effective ventilation to be carried out.

What is claimed is:

1. A heat exchanger of the type in which partition members respectively separated from each other by a spacing maintained by one of spacing members to facilitate circulation of two different air flows, with total enthalpy heat exchange occurring between said two air flows via said partition members, wherein only one side of each of said partition members is coated with lithium chloride as a moisture absorbent and polyvinyl alcohol as a binder but with no flame retardant, wherein said spacing members are corrugated, include a flame retardant which does not contribute to moisture permeability, and adhere to the coated side of said partition members, and the air permeability (JIS 8117) of said partition members is at least 200 second/100 cc.

2. The heat exchange ventilation according to claim 1, wherein said flame retardant is guanidine sulfamate.

* * * * *